US009908823B2

(12) United States Patent
Heaps

(10) Patent No.: US 9,908,823 B2
(45) Date of Patent: Mar. 6, 2018

(54) FLEXIBLE ENERGETIC MATERIALS AND RELATED METHODS

(71) Applicant: BATTELLE ENERGY ALLIANCE, LLC., Idaho Falls, ID (US)

(72) Inventor: Ronald J Heaps, Idaho Falls, ID (US)

(73) Assignee: BATTELLE ENERGY ALLIANCE, LLC, Idaho Fall, ID (US)

( * ) Notice: Subject to any disclaimer, the term of this patent is extended or adjusted under 35 U.S.C. 154(b) by 0 days.

(21) Appl. No.: 14/940,561

(22) Filed: Nov. 13, 2015

(65) Prior Publication Data

US 2017/0137337 A1 May 18, 2017

(51) Int. Cl.

| | |
|---|---|
| ***C06B 33/00*** | (2006.01) |
| ***C06B 33/12*** | (2006.01) |
| ***C06B 33/06*** | (2006.01) |
| ***D03D 23/00*** | (2006.01) |
| ***D03D 43/00*** | (2006.01) |

(52) U.S. Cl.
CPC ..... *C06B 33/12* (2013.01)

(58) Field of Classification Search
USPC ..... 149/40, 37, 42, 109.2
See application file for complete search history.

(56) References Cited

U.S. PATENT DOCUMENTS 3,813,439 A * 5/1974 Picard et al. ..... C06B 25/34 149/36
5,121,329 A 6/1992 Crump
8,007,607 B2 8/2011 Daniels et al.
2005/0258159 A1* 11/2005 Hale ..... F23Q 3/006 219/270
2008/0229963 A1* 9/2008 Nielson ..... C06B 27/00 102/364

OTHER PUBLICATIONS

Billy Clark, et al. "Development of flexible, free-standing, thin films for additive manufacturing and localized energy generation". Aug. 11, 2015, http://dx.doi.org/10.1063/1.4928570.
B.R. Clark, et al., Synthesis and characterization of flexible, free-standing, energetic thin films, Surf. Coat. Technol. (2015), http://dx.doi.org/10.1016/j.surfcoat.2015.05.048.

* cited by examiner

*Primary Examiner* — James McDonough
(74) *Attorney, Agent, or Firm* — Holland and Hart

(57) ABSTRACT

Energetic compositions and methods of forming components from the compositions are provided. In one embodiment, a composition includes aluminum, molybdenum trioxide, potassium perchlorate, and a binder. In one embodiment, the binder may include a silicone material. The materials may be mixed with a solvent, such as xylene, de-aired, shaped and cured to provide a self-supporting structure. In one embodiment, one or more reinforcement members may be added to provide additional strength to the structure. For example, a weave or mat of carbon fiber material may be added to the mixture prior to curing. In one embodiment, blade casting techniques may be used to form a structure. In another embodiment, a structure may be formed using 3-dimensional printing techniques.

13 Claims, 9 Drawing Sheets

FLEXIBLE ENERGETIC MATERIALS AND RELATED METHODS

GOVERNMENT RIGHTS

This invention was made with government support under Contract Number DE-AC07-05ID14517 awarded by the United States Department of Energy. The government has certain rights in the invention.

BACKGROUND

Energetic materials are used in a variety of applications. They may be used as explosives, pyrotechnic applications, as propellants and as fuels. In a number of instances, it may be desirable for energetic materials to provide a structural function as well. However, many types of energetic materials, including most thermitic type reactive materials, are brittle or have little strength. Various attempts have been made to provide an energetic material that may be used to form structural or load bearing components. For example, U.S. Pat. No. 8,007,607, entitled COMBUSTIBLE STRUCTURAL COMPOSITES AND METHODS OF FORMING COMBUSTIBLE STRUCTURAL COMPOSITES, describes a combustible material that includes structural reinforcing fibers such that the resulting material is capable of carrying substantial structural design loads.

In addition to issues relating to brittleness and strength, numerous energetic materials, such as thermitic type materials, can be static sensitive. The static sensitivity of such materials may create a hazard of the material being ignited or combusted at an unanticipated time, making the materials unsuitable for a variety of applications or, at least, requiring substantial fail safe mechanisms or procedures to prevent any inadvertent ignition or combustion.

Thin film energetic composites are also a growing area of research because of their potential for providing localized power generation in miniaturized applications. However, the development of both materials and manufacturing processes amenable to producing such thin film energetic materials has not been without difficulty. One synthesis approach that has combined fuel and oxidizer powders with a binder and solvent system includes forming a very thin film (e.g., approximately 100 microns or less). This technique has been utilized previously in the manufacture of capacitors and batteries as well as for prototype fabrication of laminated ceramic components. Early reporting of blade casting of an energetic material was directed to thermal battery applications and utilized magnesium (Mg) and manganese dioxide (MnO2) as the energetic composite combined with various binder-solvent systems. It has been shown that polyvinylidene fluoride (PVDF) and n-methylpyrrolidone (NMP) may be an effective fluoropolymer binder and organic solvent combination because they provide relative homogeneity (i.e., less settling and segregation of particles) and generally lead to improved combustion. In one example, such a material was synthesized and a film measuring 60 mm×6 mm and 100 micron thick were deposited and adhered to substrates. The films produced calorific output on the order of 4 kJ/g and energy propagation on the order of 0.14 m/s, suitable for thermal battery applications.

It is a continued desire in the industry to provide new materials and processes that enable energetic materials to be used in new applications and environments including use as self-supporting structural components.

BRIEF SUMMARY OF THE INVENTION

In accordance with the present invention, material compositions, methods of making and using such compositions, and resulting structures are provided herein. In one embodiment, a material composition is provided which comprises aluminum (Al), molybdenum trioxide ($MoO_3$), potassium perchlorate ($KClO_4$) and a binder. In one particular embodiment, binder comprises silicone. The material composition may further comprise a solvent. In one particular embodiment, the solvent comprises xylene.

In one particular embodiment of a material composition, aluminum is present in an amount of approximately 15 to 20% by weight (wt %), $MoO_3$ is present in an amount of approximately 32 to 41 wt %, $KClO_4$ is present in an amount of approximately 9 to 10 wt %, silicone is present in an amount of approximately 25 to 28 wt %, and xylene is present in an amount of approximately 9 to 10 wt %.

In one embodiment, the material composition may comprise $KClO_4$ in an amount of approximately 35% by weight (wt. %) or less.

In one embodiment, the material composition may comprise $KClO_4$ in an amount of at least approximately 20 wt. %

In one embodiment, the material composition may comprise $KClO_4$ in an amount of approximately 30 wt. %.

In one embodiment, the aluminum and the molybdenum trioxide are present in powder form.

In one particular embodiment, the Al powder exhibits an average size of approximately 0.08 microns.

In one particular embodiment, the $MoO_3$ powder exhibits an average size of approximately 14.0 microns.

In accordance with another embodiment of the present invention, a method is provided for forming a self-supporting energetic structure. The method includes providing a mixture comprising aluminum (Al), molybdenum trioxide ($MoO_3$), potassium perchlorate ($KClO_4$), and a binder, and forming a shape from a the mixture.

In one embodiment, 13 providing a mixture includes mixing the Al, the $MoO_3$, the $KClO_4$, and the binder with a solvent material.

In one embodiment, the method further includes de-airing the mixture prior to forming the shape, and curing the mixture subsequent to forming the shape.

In one embodiment, the act of forming a shape includes spreading a mass of the mixture onto a substrate and forming a film of the mixture that exhibits a desired, substantially uniform thickness.

In one embodiment, the desired thickness of the film is approximately 1 millimeter or greater.

In one embodiment, the method further includes providing the binder as a material comprising silicone.

In one embodiment, the method further includes providing the solvent material as a material comprising xylene.

In one embodiment, the method further includes providing the Al and the $MoO_3$ in powder form.

In one embodiment, the act of forming a shape includes forming the shape using a 3-dimensional printer.

In one embodiment, the method further includes adding at least one reinforcement element to the mixture prior to or during the act of forming a shape from the mixture.

In one particular embodiment, the act of adding at least one reinforcement element includes adding at least one carbon fiber element to the mixture.

In one embodiment, the method further includes effecting the reaction:

$$2Al+MoO_3 \rightarrow Al2O_3+Mo.$$

In one embodiment, the method further includes effecting the reaction:

$$5Al+MoO_3+KClO_4 \rightarrow 2.33Al_2O_3+Mo+KCl.$$

In one embodiment, the method further includes providing the mixture to include $KClO_4$ in an amount of approximately 35% by weight (wt. %) or less.

In one embodiment, the method further includes providing the mixture to include $KClO_4$ in an amount of at least approximately 20 wt. %.

In one embodiment, the method further includes providing the mixture to include $KClO_4$ in an amount of approximately 20 wt. %.

Other features, aspects and embodiments of the invention are discussed below. Features of one described embodiment may be combined with other embodiments, or other features of additionally described embodiments without limitation.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Embodiments of the present invention are directed to energetic mixtures, including thermite type mixtures which may, generally, comprise metals and oxides mixed with a binder composition. The metals and oxides may be provided in powder form. The mixture results in flexible material which may be cast into various shapes making it useful in numerous applications. The resulting material is resistant to water and to many solvents. Additionally, the resulting material has shown a general lack of sensitivity to electrostatic discharge and provides consistent, predictable reaction.

In one embodiment, blade casting methods may be used for the synthesis of flexible, free-standing energetic films. Such, films may include aluminum (Al) and molybdenum trioxide ($MoO_3$) powder thermites combined with potassium perchlorate ($KClO_4$) and a silicone binder. In some embodiments, a composite material, such as a carbon fiber fabric reinforcement fabric may be incorporated to improve the structural integrity of the resulting film. Films may be formed to exhibit a substantial thickness (e.g., 1 mm thick and greater) with a constant percent solids to ensure consistent rheological properties. In other embodiments, other casting methods may be used, or the material may be used in association with 3D (3-dimensional) printing processes. The resulting structures may be self-supporting and serve as structural components in other assemblies, structures, mechanisms or systems.

Figure 1:
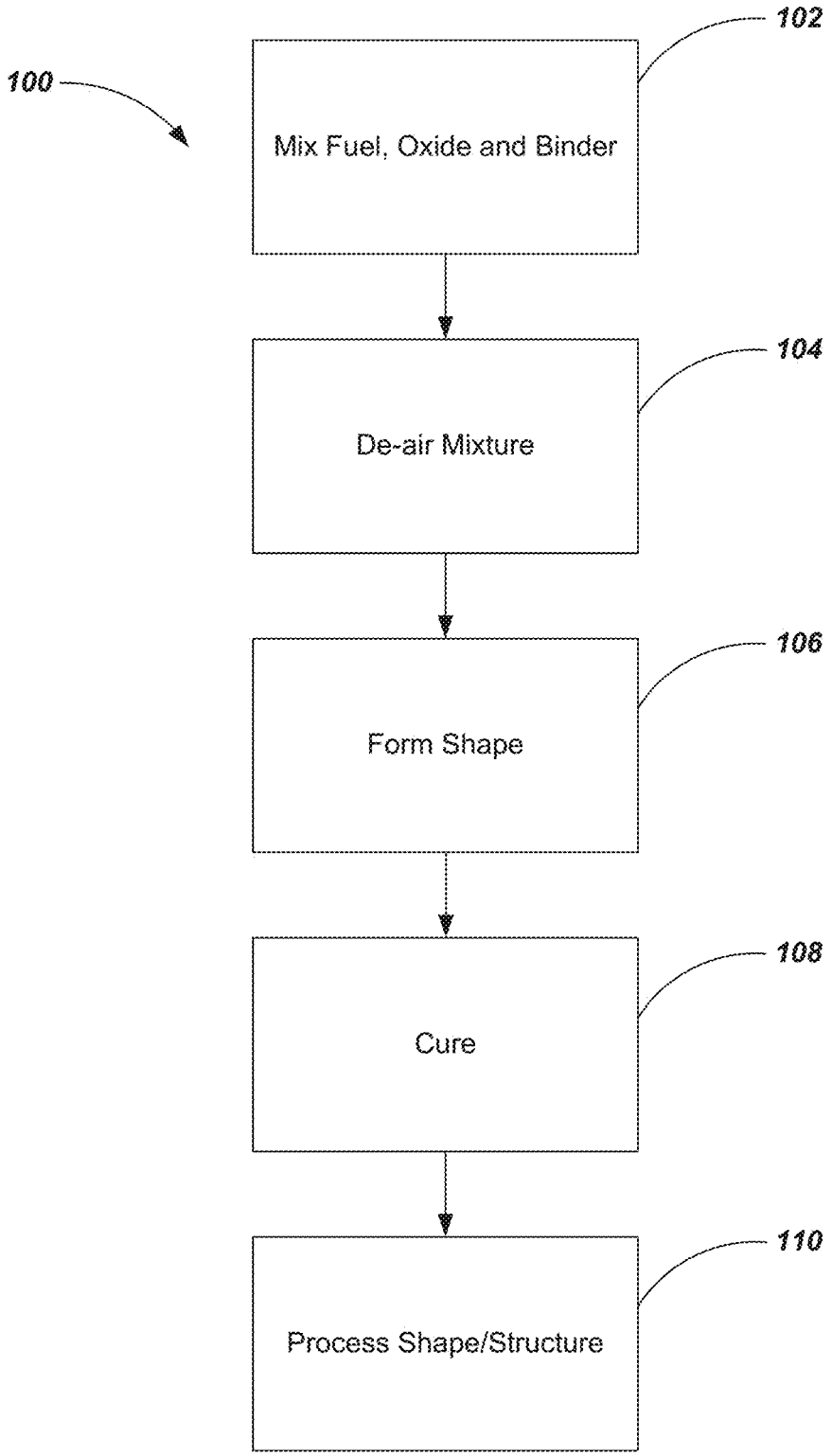
FIG. 1 is a flow chart depicting one example of a method of forming a shaped structure from an energetic material.

Referring to FIG. 1, a flow chart shows a method 100 of forming a self-supporting energetic component according to an embodiment of the present invention. The method includes mixing together a metal fuel, an oxide and a binder composition as indicated at 102. In one example, the binder composition may include a two part silicone material, an oxidizer and a solvent. In one example, the oxidizer may include potassium perchlorate and the solvent may include a hexane solvent.

Once the materials are mixed, the mixture may be de-aired as indicated at 104. The de-aired mixture may then be cast or otherwise formed into a desired shape as indicated at 106. The cast or formed shape may be cured, as indicated at 108, and additional processing of the shape may occur as indicated at 110. The additional processing may include, for example, further shaping (e.g., bending, trimming, cutting, milling), assembly with one or more additional components, or treating (e.g., coating) with further materials.

In one embodiment, the act of mixing 102 may include mixing aluminum (Al) and molybdenum trioxide ($MoO_3$) at a stoichiometric ratio. The reaction for this base energetic composite is shown in Equation 1 below:

$$2Al+MoO_3 \rightarrow Al2O_3+Mo \quad \text{(Eq. 1)}$$

Potassium perchlorate ($KClO_4$) may be added in varying mass percentages to cause the global reaction to become increasingly fuel lean. The global reaction is shown in Equation 2 below:

$$5Al+MoO_3+KClO_4 \rightarrow 2.33Al_2O_3+Mo+KCl \quad \text{(Eq. 2)}$$

A binder-solvent system may be added which includes, in one example, silicone and xylene. In one embodiment, the mass of silicone and mass of xylene may be adjusted such that the material is cast at approximately 55% solids concentration by volume.

In one embodiment, the composition may include Al powder in the amount of approximately 15 to 20% by weight (wt %), $MoO_3$ powder in the amount of approximately 32 to 41 wt %, $KClO_4$ in the amount of approximately 9 to 10 wt %, silicone in the amount of approximately 25 to 28 wt %, and xylene in the amount of approximately 9 to 10 wt %.

In one non-limiting example, the composition includes approximately 15.2 wt % Al, approximately 9.3 wt % $KClO_4$, approximately 40.6 wt % $MoO_3$, approximately 25.6 wt % silicone (e.g., 23.3 wt % of part A and 2.3 wt % of part B of Mold Max 30® silicone available from Smooth-On, Inc.), and approximately 9.3 wt % xylene.

In another non-limiting example, the composition includes approximately 19.4 wt % Al, approximately 10 wt % $KClO_4$, approximately 32.6 wt % $MoO_3$, approximately 28 wt % silicone (e.g., 25.5 wt % of part A and 2.5 wt % of part B of Mold Max 30® silicone), and approximately 10 wt % xylene. Other non-limiting examples as set forth below.

In one embodiment, the act of forming into a shape may include blade casting or tape casting. For example, with reference to FIGS. 2A and 2B, a mass of energetic material 120 (FIG. 2B) in slurry form may be dispersed onto a substrate 122 that is positioned over the bed 124 of a coating table. In one embodiment, the bed 124 may include a glass bed while the substrate 122 may include a Mylar® film or stainless steel foil. A doctor blade 126 may then be drug across the substrate 122 forming a thin film 128 of energetic material on the substrate equal in height to a gap 130 or opening formed in the doctor blade 126. Excess reactive material is scraped and collected by the traversing doctor blade for use in forming other structures or to otherwise be disposed. The thin film 128 may be formed to exhibit a thickness of, for example, between 1 mm and 3 mm, the resulting structure being flexible, shapeable and self-supporting.

As noted above, in other embodiments, other fabrication techniques may be used including, for example, extrusion, 3D printing, or other casting or molding techniques. Non-limiting examples of 3D printing manufacturing processes and systems are described in U.S. Pat. No. 5,121,329, issued on Jun. 9, 1992 (entitled APPARATUS AND METHOD FOR CREATING THREE-DIMENSIONAL OBJECTS), the disclosure of which is incorporated by reference herein in its entirety.

Example 1

In one particular example, the following experiments were conducted with regard to the production of thin film energetic materials:

Several films were synthesized using a combination of an energetic composite, an additive, and a binder-solvent system. The energetic composite for all films included aluminum (Al) and molybdenum trioxide ($MoO_3$) mixed at a stoichiometric ratio. The reaction for this base energetic composite is shown above in Equation 1.

Potassium perchlorate ($KClO_4$) was added in varying mass percentages, from 0-35 wt %, which caused the global reaction to become increasingly fuel lean. The global reaction is shown above in Equation 2.

The binder-solvent system included silicone and xylene. The mass of silicone was held constant for all films, while the mass of xylene was increased to ensure all films were cast at 55% solids concentration by volume. Table 1, below, shows the name, supplier, and applicable particle size for all the materials used in the films. With the exception of $KClO_4$ the mass of all other components were held constant.

TABLE 1

| Material | Supplier | Characteristic Particle Size (μm) |
|---|---|---|
| Al | Nova Centrix (Austin, Tx) | 0.08 |
| MoO3 | Alfa Aesar (Ward Hill, Ma) | 14.0 |
| KClO4 | Sigma Aldrich (St. Louis, Mo) | 151.0 |
| Mold Max 30 ® Silicone | Smooth-On (Easton, Pa) | N/A |
| Xylene | Macron Fine Chemicals (Center Valley, PA) | N/A |

The base energetic reaction consisted of 670 mg of Al and 1790 mg of $MoO_3$. Table 2, below, shows the mass of $KClO_4$ corresponding to the percent added to the powder components of the base reaction for the various samples.

TABLE 2

| $KClO_4$ wt % | Mass $KClO_4$ (mg) | Mass Xylene (mg) |
|---|---|---|
| 0% | 0.00 | 1410 |
| 5% | 304 | 1753 |
| 10% | 609 | 2097 |
| 15% | 914 | 2440 |
| 20% | 1218 | 2784 |
| 25% | 1523 | 3127 |
| 30% | 1828 | 3471 |
| 35% | 2132 | 3814 |

The mass of $KClO_4$ for each percent was determined using only the mass of the Al, $MoO_3$, and silicone binder. The solvent was excluded from the mass percent calculation due to the film being dried before testing. These components were then sealed in a mixing vessel while the binder-solvent system was prepared. The silicone binder was a two part tin-cured silicone. The total mass of binder used in each film was 3632 mg. The binder was mixed by hand with an appropriate mass of xylene (see Table 2) to maintain a constant solids concentration. The binder solvent system was added to the powder in the mixing vessel and components were mixed using a centripetal planetary mixer (Thinky™) at 1600 RPM for 90 seconds. Total batch masses varied from 7,503 mg for the 0% $KClO_4$ film to 12,041 mg for the 35% $KClO_4$ film.

Figure 2A:
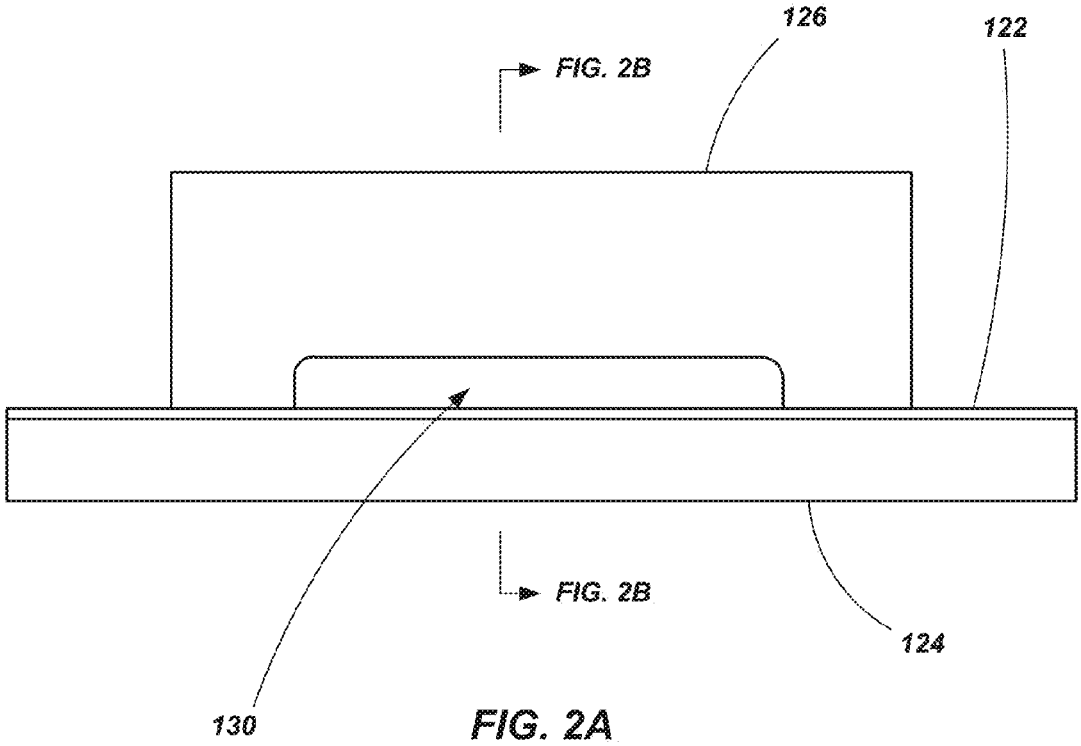
FIG. 2A is a front view of a blade casting apparatus in accordance with an aspect of the present invention.
Figure 2B:
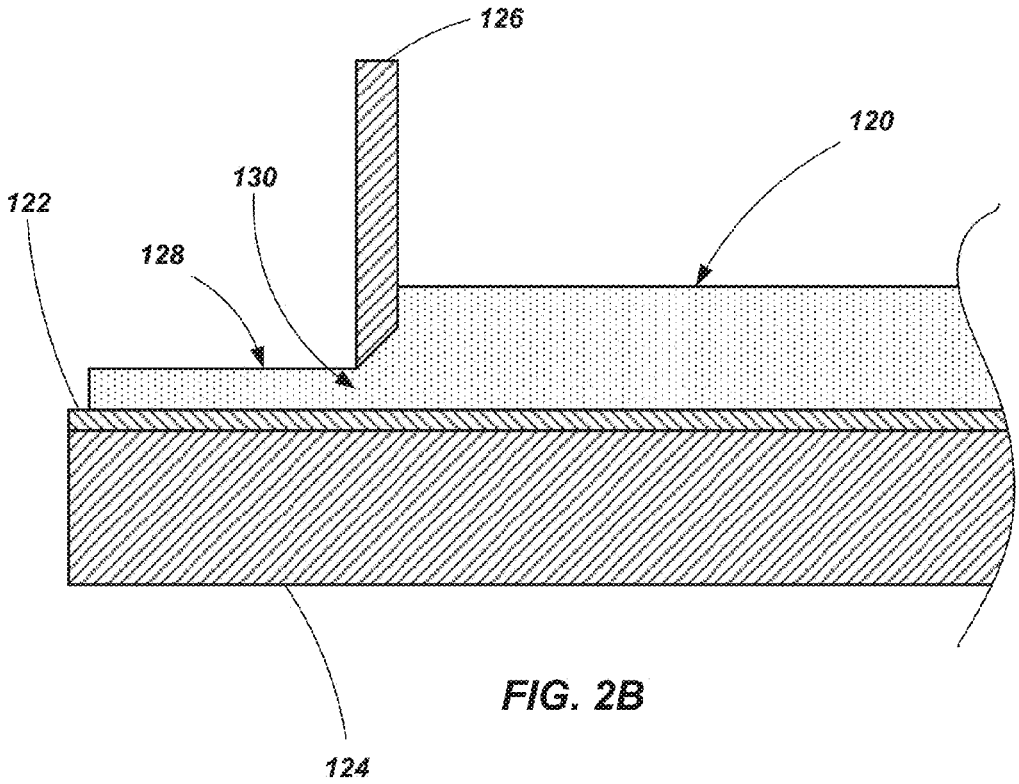
FIG. 2B is an enlarged cross-sectional view of the apparatus shown in FIG. 2A, with a mass of slurry material disposed thereon.

Once mixing was complete, the slurry was placed in a vacuum chamber and subjected to 50 kilopascals (kPa) vacuum to de-aerate the slurry before loading onto a doctor blade apparatus (similar to that shown in FIGS. 2A and 2B). The doctor blade was used to create a uniform thin film by drawing the blade over a slurry to produce a constant 1 mm thick film on a substrate. The thickness of the film was equal to the gap height of the blade (See FIGS. 2A and 2B). All films were coated onto stainless steel foil substrates that were 50 microns thick. The coatings were then placed in an oven at 60° C. for 24 hours to evaporate the solvent. After drying, the coatings were cooled at room temperature in a fume hood for 24 hours. The free standing 1 mm thick film was cut into 6×50 mm strips using scissors for combustion experiments.

Energy propagation studies were conducted on each of the samples. To establish repeatability, four samples of each composition were examined and flame speeds were measured. For each examination, a glass slide with a sample strip attached was placed on a steel block housed in a combustion chamber with viewing windows. The sample was aligned with the camera perpendicular to the direction of flame propagation. The film was ignited with a butane flame and the energy propagation was recorded at 250 frames per second at a resolution of 800×480 pixels using a Vision Research Phantom VII high speed camera. The videos were converted to a series of still images and were processed to find the horizontal position of the leading edge of the flame using National Instruments Vision software. The reported flame speeds (discussed below) represent the average of the four samples for each composition. The uncertainty reported corresponds to the standard deviation of the four samples measured, which is the largest source of uncertainty in the experiments.

REAL code (Timtec L.L.C.), a thermal equilibrium software model, was used to calculate theoretical heat of combustion of the global reaction in Equation 2 (above). These simulations were performed assuming a constant volume of 0.01 $m^3$/kg and internal energy equal to zero.

A Netzsch STA 449 DSC (differential scanning calorimetery) and TGA (thermal gravity analyzer) device was used to measure the heat flow as a function of temperature and time. For the DSC analysis, a 10 mg sample of each film was loaded into an alumina crucible with no lid and placed in the diagnostic. Samples were heated to 900° C. in an air environment at rate of 10K/min (KPM). The sample was compared to an empty reference sample in order to gather energy and mass change data during the heating process.

It is noted that sintering can occur during heating and melting, ultimately affecting heat transfer in the STA measuring head. To establish consistency, repeatability and minimize artifact alterations of results, three experiments were performed for each sample. Temperature calibrations for the instrument were performed using melting of a set of metal standards resulting in a temperature accuracy of +/−1° C.

Figure 3:
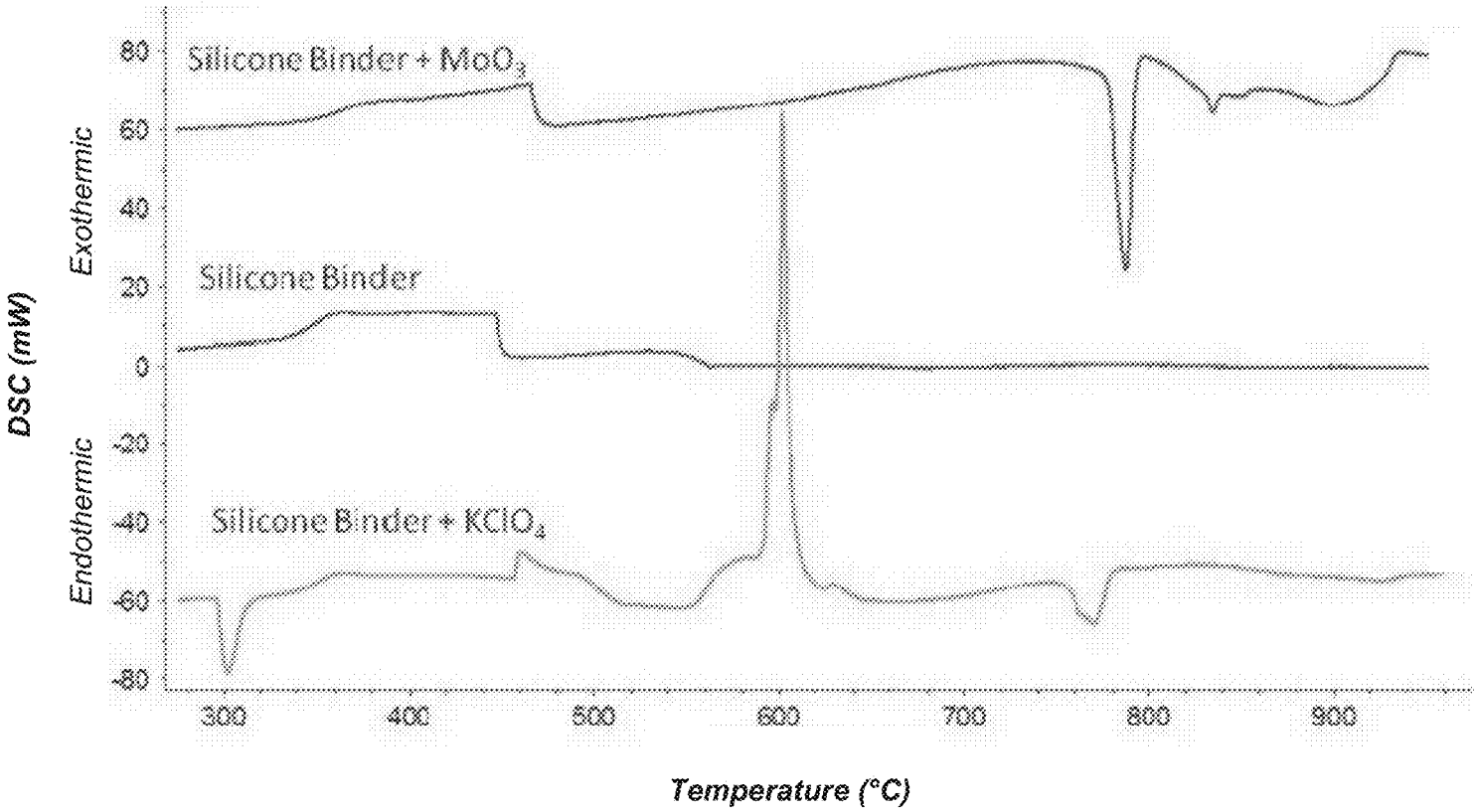
FIG. 3 is a chart showing differential scanning calorimetry (DSC) results according to certain aspects of the present invention.

Reaction propagation of the films were found to vary by $KClO_4$ concentration. Generally, propagation of a 0 wt % $KClO_4$ sample was determined to be unsteady while propagation of a 30 wt % $KClO_4$ sample was found to be in steady state. The flame associated with 0 wt % $KClO_4$ samples appeared to spiral and exhibit oscillating behavior at the leading edge of the flame. This instability has been observed in previous combustion studies of solid energetic composites. Some studies have attributed this behavior to thermal instabilities that can manifest from perturbation of variables that reduce the flame temperature and reaction energy. Other studies have observed thermal instabilities with Al+CuO and Al+$MoO_3$ propagation when a diluent was added at high concentrations (the diluent being alumina, which did not participate in the reaction but acted as a thermal heat sink). Similarly, in this study the silicone binder was thought to act as a heat sink in the low $KClO_4$ concentration samples. To investigate this possibility, DSC analyses were performed to assess the exothermic behavior of silicone binder alone and combined with each individual reactant. The chart in FIG. 3 shows that the silicone binder exhibits exothermic behavior with $KClO_4$ starting at about 550° C. but not with the other reactants. The lack of reactivity with the other reactants gives strong evidence that the silicone binder acts as a thermal sink in the reactions with low concentrations of $KClO_4$.

Figure 4:
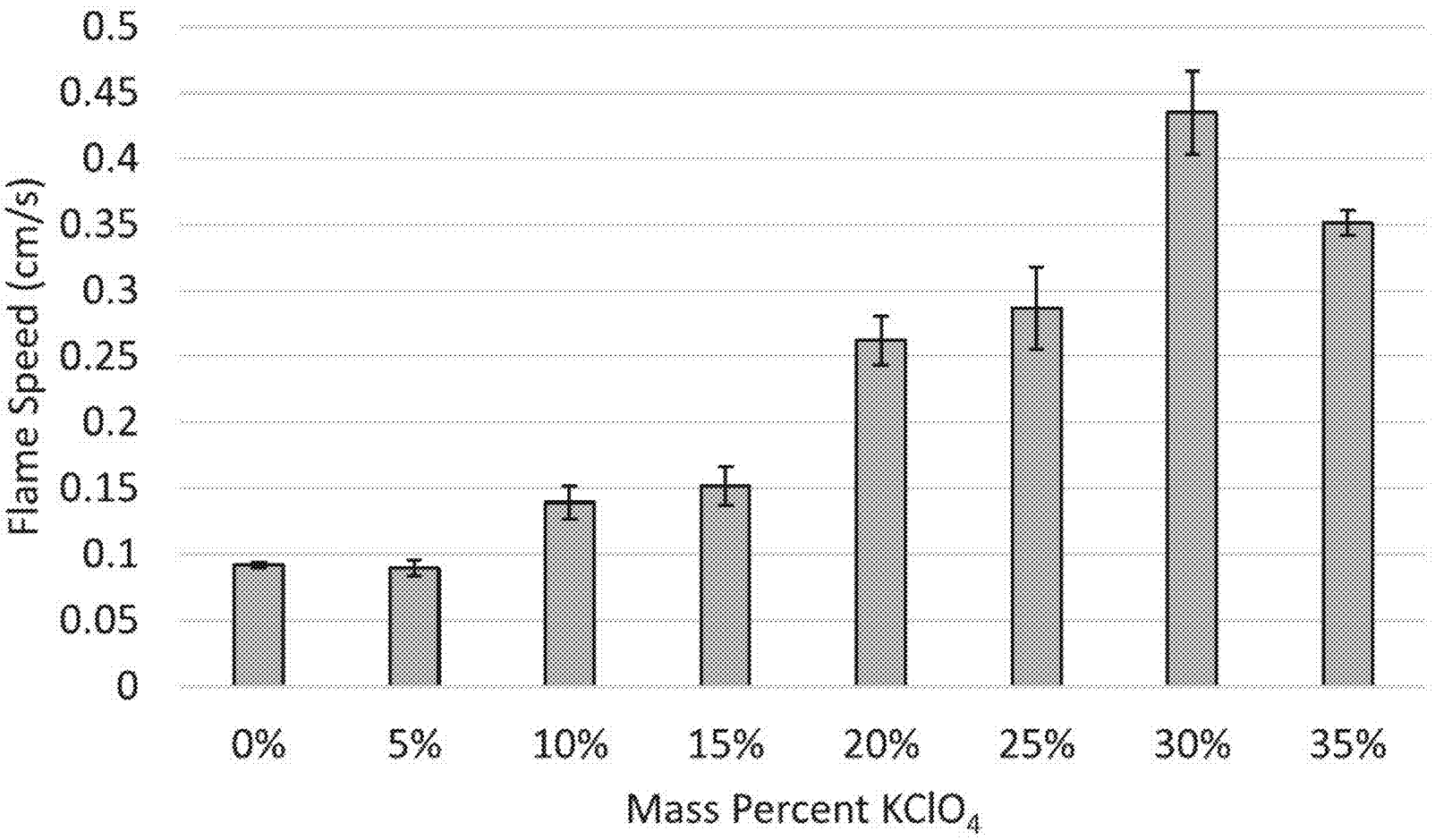
FIG. 4 is bar chart showing flame speed for various material samples according to an aspect of the present invention.

FIG. 4 charts the average flame speeds for all compositions with the associated uncertainty (shown as an "I" at the top of each bar). As the mass percent $KClO_4$ is increased the average flame speed is increased up to a maximum at 30 wt. % $KClO_4$ of 0.435 cm/sec. The uncertainty bars demonstrate the high repeatability in energy propagation of these synthesized materials. It is noted that a film composed of Al+$KClO_4$ was also prepared using the same binder-solvent system. The result was that without $MoO_3$, the film did not sustain self-propagation and quenched upon ignition.

As noted above, the propagation rate measurements showed that the increased $KClO_4$ concentration promotes steady propagation with no observed thermal instabilities. FIG. 4 suggests that added $KClO_4$ may react with the silicone binder such that the binder provides chemical energy to the overall reaction to overcome the thermal instabilities observed at lower $KClO_4$ concentrations. The reaction between silicone binder and $KClO_4$ has been previously documented by others, wherein the reaction was determined to be highly gas generating and potentially useful as inflators for restraint systems. However, the observed appearance of the flame for 30 wt % $KClO_4$ samples was not consistent among sequential frames with varied flame width observed by light intensity. While the leading edge propagates forward consistently, the range of heated film illuminated showed an overall non-uniform propagation.

Figure 5:
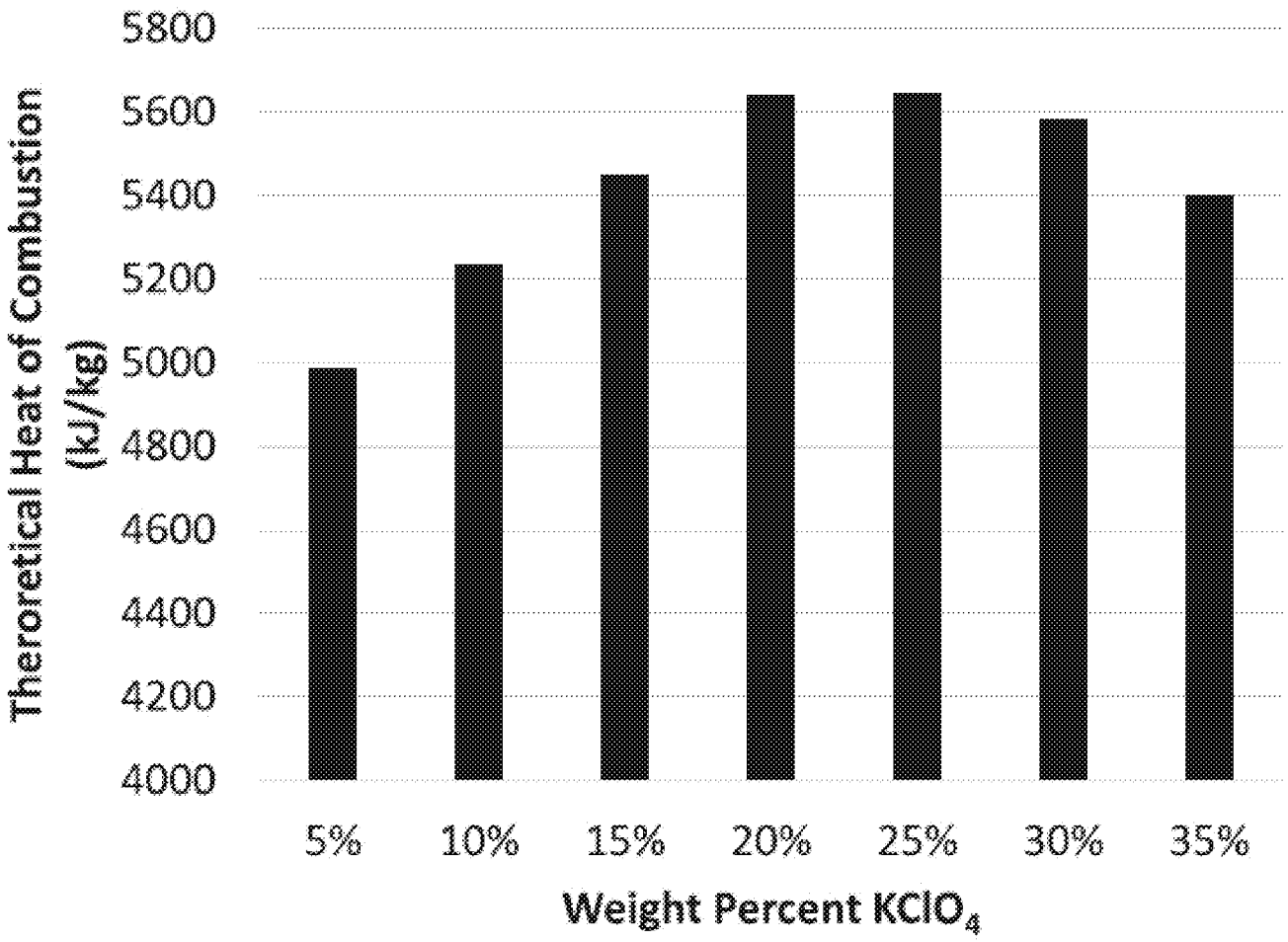
FIG. 5 is a bar chart showing theoretical heat of combustion for various samples according to an aspect of the invention.

The simulation results in FIG. 5 show a relative heat of combustion (ΔHc) plateau in the range of 20-30 wt. % $KClO_4$ concentration corresponding to roughly 5600 kilojoules per kilogram (kJ/kg). Also noteworthy is that the gradual increase in ΔHc correlates well with the increase in flame speed up to 20 wt % $KClO_4$ (FIG. 4). The correlation implies the increasing trend in flame speed (FIG. 4) is promoted by higher energy content of the reaction. At 20 wt. % $KClO_4$ the thermal instabilities in energy propagation were also no longer observed, also consistent with diffusion controlled energy propagation. However, for $KClO_4$ concentrations greater than 20%, energy liberated from the reaction was minimally affected by further increases in $KClO_4$ concentration such that further increases in energy propagation are no longer attributed to additional energy content from the reaction chemistry. These simulations do not account for silicone, but the trends in heat flow shown in FIG. 5 are consistent with the flame propagation observations, suggesting that the silicone binder has limited participation in chemical energy liberated at low (i.e., <20 wt. %) $KClO_4$ concentrations.

Figure 6:
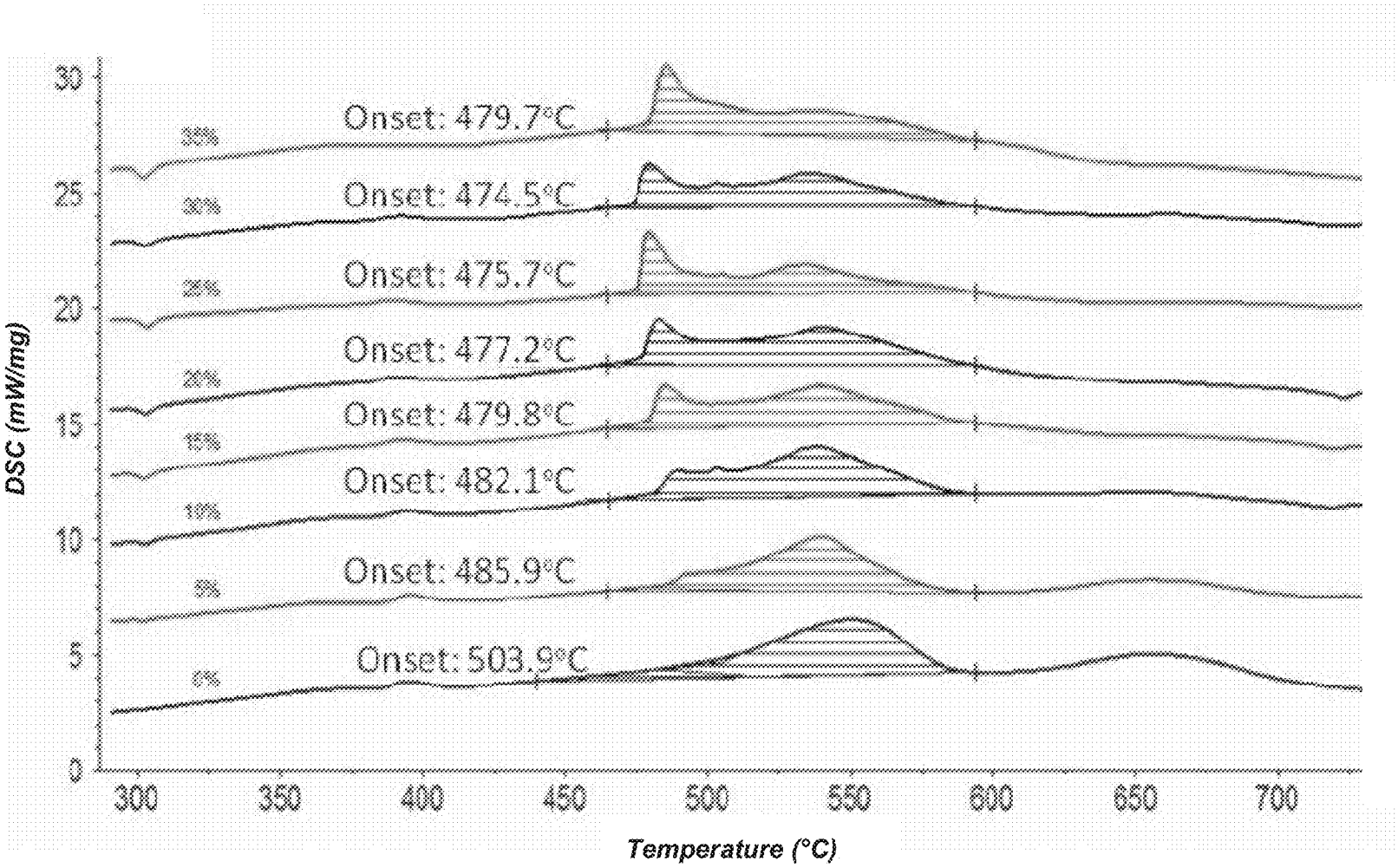
FIG. 6 is a chart showing differential scanning calorimetry (DSC) for various material samples according to certain aspects of the present invention.

FIG. 6 shows heat flow curves measured using the DSC for each sample analyzed in FIG. 4. A dramatic shift in the exothermic reaction from 0-30 wt % KClO4 indicates that the addition of $KClO_4$ alters the mechanism for reaction. As the concentration of $KClO_4$ increases the onset reaction temperature decreases to a minimum at 30 wt. % $KClO_4$ (from about 503.9 to about 474.5° C.). Since $KClO_4$ has a lower enthalpy of formation (−430.12 kJ/mol) than $MoO_3$ (−745.17 kJ/mol), less energy is required for the fuels (and in particular the silicon) to oxidize with $KClO_4$ compared with $MoO_3$. As $KClO_4$ concentration increases, the onset temperature is reduced by 24.2° C. because the silicone binder onset with $KClO_4$ (seen in FIG. 3 as 461° C.) is before the onset of Al oxidation (seen in FIG. 6 at about 503° C.). The silicone binder participates in the reaction owing to the greater oxygen content at higher $KClO_4$ concentrations as seen in FIG. 3. The exothermic interaction between the silicone binder and $KClO_4$ is unique and not observed with the $MoO_3$ oxidizer. As $KClO_4$ concentration increases, participation of the silicone binder as a fuel in the overall exothermic reaction contributes added heat to stabilize energy propagation.

Figure 7:
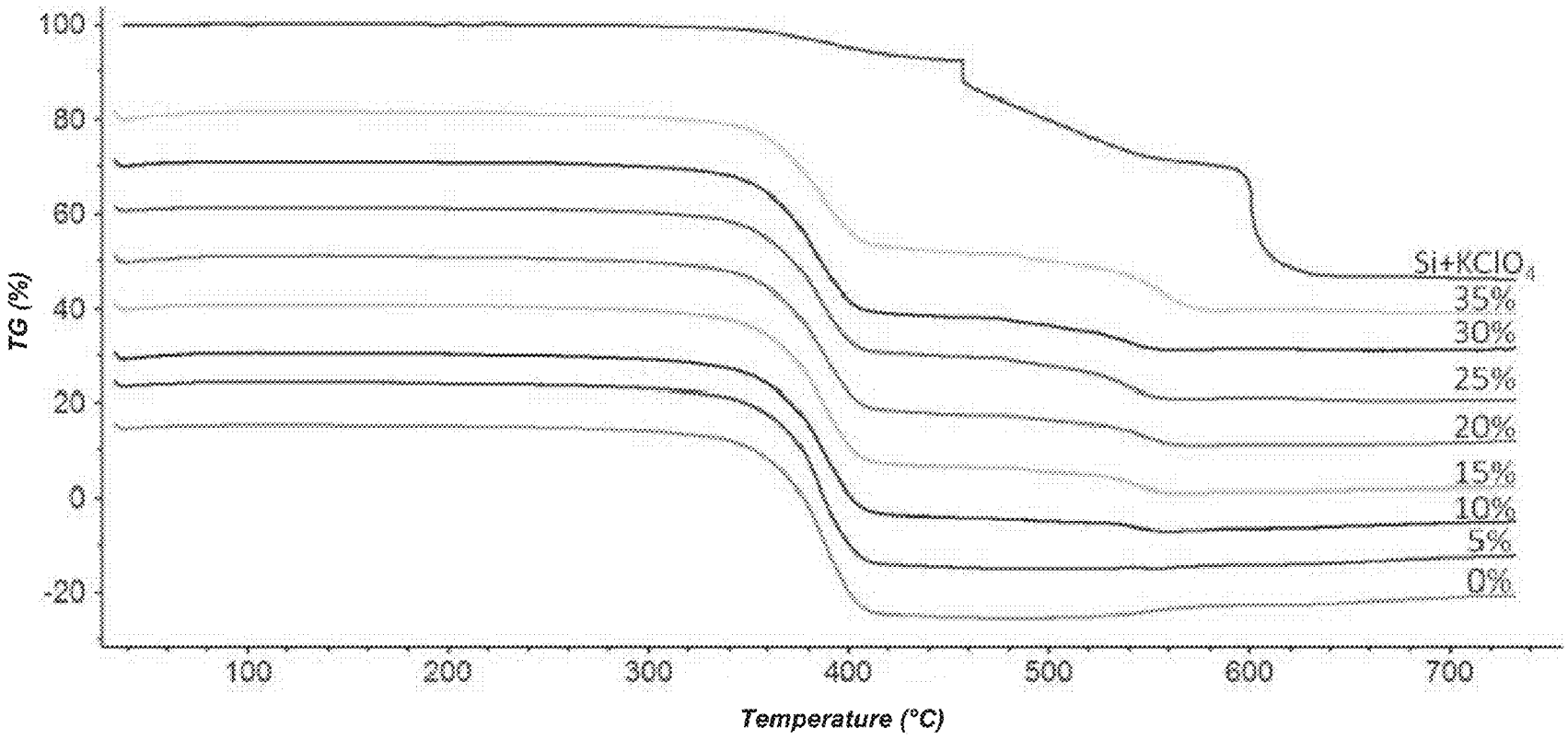
FIG. 7 is a chart showing thermal gravity analyzer (TGA) results according to certain aspects of the present invention.

FIG. 7 shows the mass loss curves measured with the TGA. The addition of $KClO_4$ introduces a multiple step mass loss, which becomes more pronounced in the higher $KClO_4$ concentration films. This multistep behavior may be indicative of the silicone binder reacting as a fuel. FIG. 3 shows the binder onset with $KClO_4$ at about 461° C., coincident with the second mass loss step. If the heat flow trace for silicone binder in FIG. 3 is examined, an exotherm is present beginning at about 337° C. This exotherm corresponds to the silicone reacting with the air environment present in the DSC. This reaction correlates to the first mass loss present in the mass loss curves in FIG. 7 for the films. This leads to an increasingly lean global reaction when $KClO_4$ is added to the films. This shift in stoichiometry may be responsible for the increase in onset temperature for the 35 wt. % $KclO_4$ sample. The results from analysis of equilibrium kinetics provides evidence that while the heat of combustion remains relatively unchanged between 20-30 wt. % $KclO_4$, the temperature required to initiate the reaction is reduced to a minimum at 30 wt. % $KclO_4$. If flame propagation is considered to be a continual series of ignition events, assuming thermal properties are not significantly changing and convective influences are negligible, then the film that requires the lowest temperature to achieve ignition should display the fastest flame speeds, as seen here. Also, lower onset temperature and more liberated heat from the silicone binder participation in the reaction facilitates more heat transfer through the film and enables stable propagation.

Example 2

In another example, the following experiments were conducted with regard to the production of thin film energetic materials:

Three energetic thin films were synthesized (films A, B and C) using a combination of an energetic composite, an additive, and a binder system. The composite material for all films included aluminum (Al) and molybdenum trioxide ($MoO_3$) powder. Potassium perchlorate ($KClO_4$) was used as the additive in varying mass percentage concentrations. The binder system included Mold Max® 30 RTV silicone and xylene. A 12 by 12 plain weave carbon fiber fabric, supplied by APC Composites (Livermore, Calif.), made of medium modulus carbon strands produced from polyacrylonitrile was used as the reinforcement fabric for Film C. Ease Release 200, supplied by Smooth-On (Easton, Pa.), was used as the release agent in this study. Table 3 (below) shows the name, supplier, and average characteristic size, where applicable, for all the materials used in the films.

TABLE 3

| Material | Supplier | Average characteristic size (microns) |
|---|---|---|
| Al | Nova Centrix (Austin, TX) | 0.08 |
| $MoO_3$ | Alfa Aesar (Ward Hill, MA) | 14.0 |
| $KClO_4$ | Sigma-Aldrich (St. Louis, MO) | 151.0 |
| Mold Max 30 ® silicone | Smooth-On (Easton, PA) | N/A |
| Xylene | Macron Fine Chemicals (Center Valley, PA) | N/A |
| Carbon fiber fabric | ACP Composites (Livermore, CA) | N/A |

Table 4 (below) shows the mass (in milligrams) of each component used in the synthesis of the specified films. The base energetic reaction consisted of Al and $MoO_3$. The mass of $KClO_4$ was found using a percentage of the mass of the Al, $MoO_3$, and silicone binder. The solvent was excluded from the mass percent calculation due to the film being dried completely before testing. Film A contained 15% by mass $KClO_4$, where Film B and Film C each contained 30% $KClO_4$.

TABLE 4

| | Al | MoO3 | KClO4 | Mold Max 30 ® silicone | Xylene |
|---|---|---|---|---|---|
| Film A | 670.2 | 1790.7 | 707.7 | 3636.4 | 2441.7 |
| Film B | 670.8 | 1790.3 | 1523.3 | 4870.8 | 2417.0 |
| Film C | 670.4 | 1790.9 | 1523.6 | 4888.6 | 2840.3 |

These components (Al, $MoO_3$ and $KClO_4$) were then sealed in a mixing vessel and set aside, while the binder-solvent system was prepared. The total mass of binder used in each film is listed in Table 4 and was mixed at the manufacturer's ratio of 10 parts A to 1 part B. The binder was then mixed by hand with an appropriate mass of xylene, shown in Table 4, to maintain constant percent solids in the slurry. The binder solvent system was added to the powder in the mixing vessel and components were mixed using a centripetal planetary mixer (Thinky™) at 1600 RPM for one minute and 30 seconds. Total batch masses varied from 9,246 mg for the Film A to 11,158 mg for Film B and Film C. The mixed slurry was placed in a vacuum chamber at 50.53 kPa of vacuum to de-aerate the slurry. The level of vacuum was carefully monitored to ensure that only air was being pulled from the slurry as a slurry that is subject to an excess vacuum (e.g., in excess of 101.31 kPa) may cause the solvent in the slurry to boil, causing the slurry to foam. The slurry was then loaded into a blade casting machine similar to that shown in FIGS. 2A and 2B.

A layer of Mylar® substrate was applied to the glass plate of the casting machine using a liquid wetting agent to ensure that the surface of the substrate did not wrinkled. Film A and Film C were cast with a coating of release agent applied to the Mylar® substrate to allow easier removal of the finished film. Film B was cast on a Mylar® substrate that was only half coated, length wise, with a release agent to test the effect of the release agent on the flame speed. A micrometer adjustable blade, which enabled precise control in film thickness, was used to cast the films on the Mylar® substrate at a constant 1 mm thickness. The slurry was poured onto the substrate to provide even coverage across the Mylar® and the blade of the coating machine was drawn across the surface of the Mylar® at a constant speed of 12.7 mm/s. Keeping the speed of the blade constant was considered to be desirable as variations in speed may cause variations in thickness of the resulting film. Film C was synthesized using an additive manufacturing approach where a 0.5 mm thick coating was cast and, while still liquid, the carbon fiber fabric reinforcement was laid onto the 0.5 mm thick film. The carbon fiber fabric was lightly tamped until the slurry had flowed through the fabric to promote adhesion between the slurry and the carbon fiber fabric. A second layer of slurry was poured onto the carbon fiber fabric and the blade was drawn over this layer to generate the final film thickness of 1 mm.

To dry the film, an acrylic box with evenly spaced holes was placed over the bed of the coating machine. This box ensured a consistent airflow over the entire film and helped to prevent cracking as the film cured. The film was allowed to cure for 24 hours at room temperature and was then peeled off the Mylar® substrate. The film was free standing and extremely flexible once cured. The silicone in the film provided support for the powdered energetic material and enabled the film to be rolled or even folded over on itself without cracking or breaking.

The slurry dried to form a film that was 50 mm wide, 100 mm long, and 1 mm thick. The samples were cut into strips using a paper cutter. The resulting strips were 6 mm wide and 50 mm long. To ensure repeatability, four samples of each composition (Film A, B and C) were examined and the flame speeds were measured. The uncertainty associated with the flame speed measurements was determined from the standard deviation of the four samples examined for each film and far greater than the uncertainty based on resolution of the diagnostic instrumentation. The films were placed on a ceramic pedestal and initiated with a butane igniter. Flame propagation was recorded at 250 frames per second at a resolution of 800×480 pixels using a Vision Research Phantom VII high speed camera. The videos were converted to a series of still images and these images were processed to find the horizontal position of the leading edge of the flame using National Instruments Vision Builder software. The reported flame speeds (discussed below) are the average flame speed for each composition.

Figure 8:
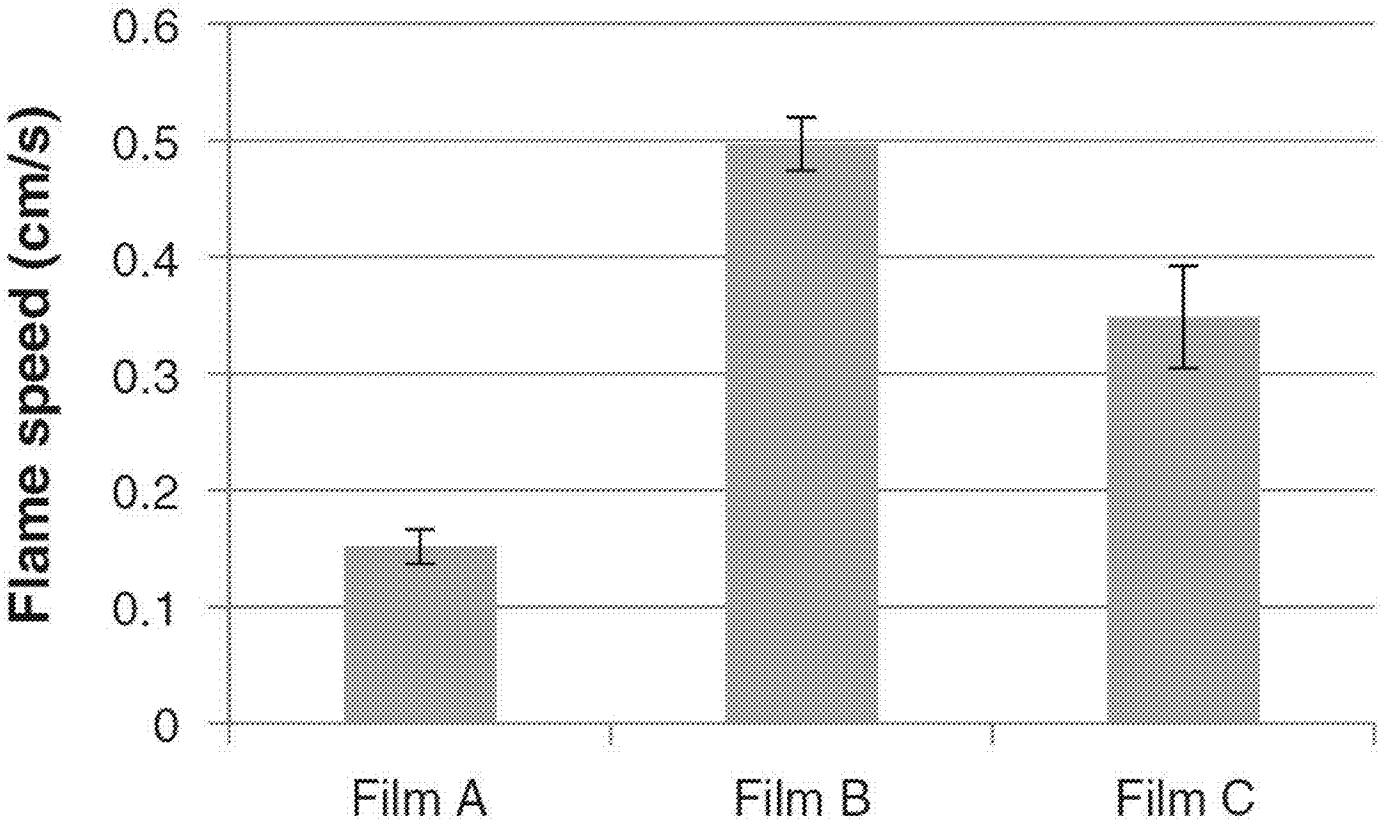
FIG. 8 is bar chart showing flame speed for various material samples according to an aspect of the present invention.

FIG. 8 shows the average flame speed results for the films examined in this example with their associated uncertainty (shown as an "I" at the top of each bar). Film A burned the slowest of all the tested samples at 0.152±0.015 cm/s, while Film B had the highest flame speed, 0.497±0.023 cm/s. The addition of the reinforcement fabric slowed the speed by 30% to 0.349±0.044 cm/s.

Figure 9:
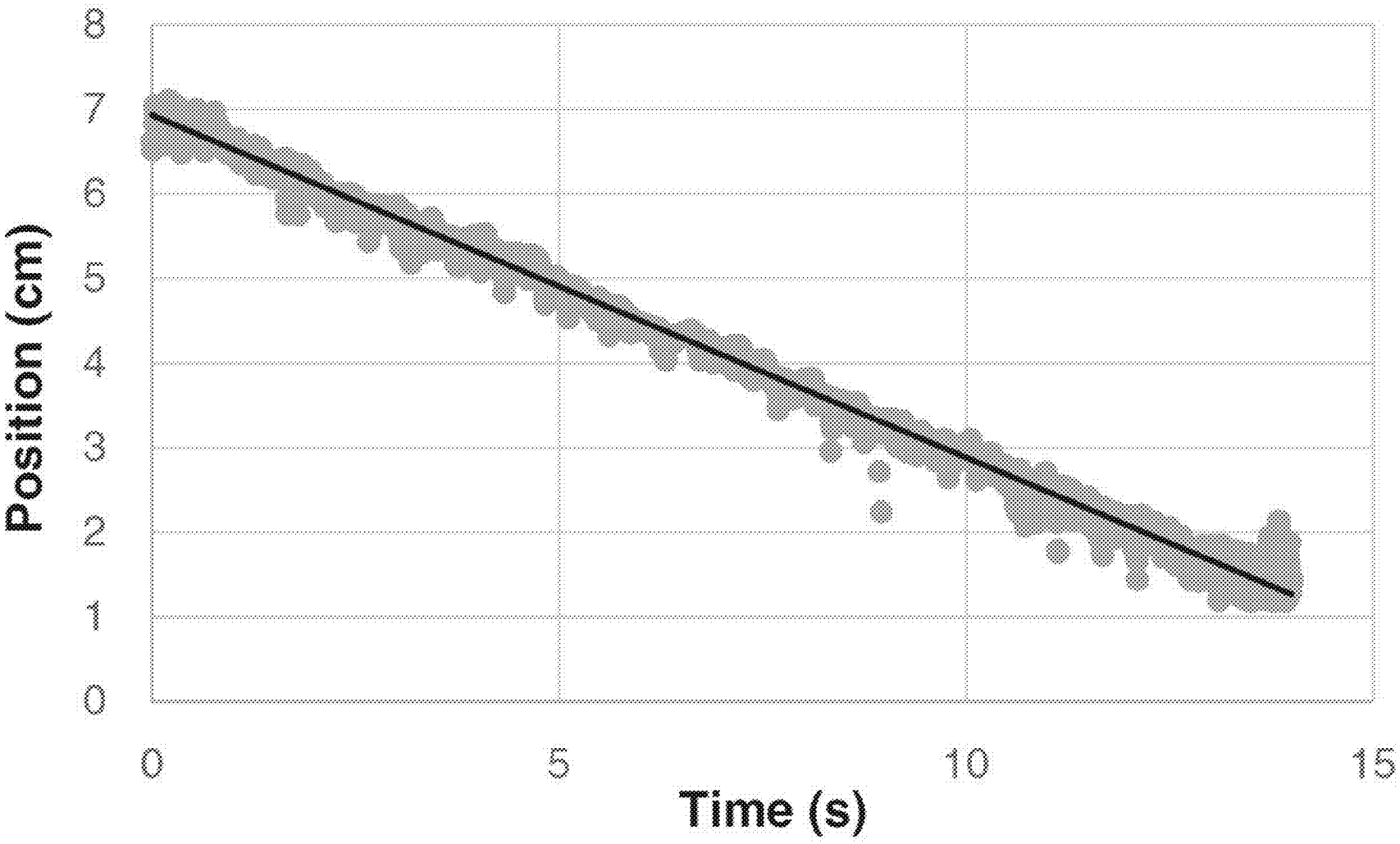
FIG. 9 is a chart showing flame position as a measure of time according to an aspect of the present invention.

FIG. 9 shows the position (length) versus time plot for Film B. The sample was cut in such a way to ensure that only one half of the film would be in contact with the release agent when cast. It can be seen in FIG. 8 that there is no significant change in the slope of the data on the graph. The linearity of the position versus time plot indicates that the use of the release agent will not affect the performance of the films.

The results indicate that as $KClO_4$ wt. % increases, so does the flame speed of the film. The significant increase in flame speed could be attributed to the dominant mode of energy propagation. It has been reported elsewhere that Al+$KClO_4$ reactions exhibit low mass loss during reaction. This means that negligible gas is generated by the reaction and the dominant mode of energy propagation is conduction. Since the films have few interior air voids, a conductively dominant reaction is going to transfer energy through the film more efficiently than a convectively dominant reaction. Also, $KClO_4$ could replace $MoO_3$ as the preferred oxidizer reacting with Al. If this is assumed, $KClO_4$ in Film A would only consume 367.5 mg of the approximately 670 mg present, leaving the remaining Al to react with $MoO_3$. Comparing theoretical heats of combustion (found using REAL code), the reaction between Al and $KClO_4$ (i.e., 9795.5 kJ/kg) would produce significantly more energy than the reaction between Al and $MoO_3$ (i.e., 4401.9 kJ/kg). This comparison estimates that potentially half the Al in Film A is reacting with an oxidizer (i.e., $MoO_3$), generating less energy than if Al was reacting with $KClO_4$. Film B and C contain enough $KClO_4$ to fully oxidize Al in the film with approximately 125 mg of oxidizer remaining and therefore lead to higher energy generation compared with Film A. The remaining oxidizer is then available to react with the silicone binder. This added heat from participation of the silicone binder would promote energy propagation and thus flame speed.

Assuming that thermal properties vary negligibly between Films A and B, the primary drivers for increased flame speed are combustion properties such as flame temperature, heat of combustion and activation energy. Film B potentially exhibits nearly twice the heat of combustion compared with Film A (based on thermal equilibrium calculations) and this correlates well with the observation that Film B also exhibits increased flame speed compared with Film A. It is further noted that silicone-based rubber reacting with $KClO_4$ has been documented such that incorporating a silicone binder in this example also provides a reactive medium to bind the reactant components into a continuous matrix and produce additional calorific output.

While Film B and Film C share similar masses of energetic components, it is noted that the flame speed for Film C is lower than Film B. This decrease in flame speed can be attributed to the introduction of the reinforcement fabric in Film C.

Research on carbon reinforced polymer matrix composites to determine the flammability of the composites used in the aviation industry have been reported. For example, some studies have shown that carbon fiber is not flammable, but the resin encasing the carbon fiber fabric will begin to vaporize at 300° C., and in the gas phase the resin will ignite and burn. Studies have further noted that while the resin burns, the carbon fiber fabric acted as insulation. Due to this, the carbon fabric may act more like a heat sink in the reactive film absorbing energy generated by the reaction. This behavior is consistent with the decrease in flame speed associated with adding the reinforcement to the energetic film and establishes the feasibility of synthesizing structurally reinforced energetic films.

Samples of the films were also subjected to mechanical testing. To prepare the samples for mechanical testing, the films were cut into strips 2.0 cm wide by 1 mm thick by 6.3 cm long. A SATEC Systems, Inc., Grove Ville Pa., model 60HVL Universal Testing Machine was implemented to test the mechanical properties of the films. A custom apparatus made from four, 0.635×3.80×45 cm steel straps was constructed to support the samples during testing. The prepared samples were loaded into the apparatus so that the majority of fibers were oriented along the axis of force, then opposite ends of each sample were clamped securely in place for tensile testing. The samples were pre-loaded until taut at which time a tensile load was applied at a rate of 444.8 N/min until the sample failed.

Table 5 shows the maximum tensile load and the maximum stress, $\sigma_{max}$, for Film B and Film C. Film B failed upon initial loading causing the maximum load of 2.27 kg to be an estimate based on measurement errors at low loads. When the carbon fiber fabric is added to the film (i.e., Film C) the maximum load supported by the film is increased by approximately 3200%, to 72.35. Similarly, the inclusion of the reinforcement fabric in the film results in a dramatic increase in the maximum load supported by the film as expected. This results in an increase in $\sigma_{max}$ of 17,740% when compared with the non-reinforced film.

TABLE 5

| | Maximum Load (Kg) | $\sigma_{max}$ (kPa) |
|---|---|---|
| Film B | 2.27 | 861.84 |
| Film C | 72.3 | 168,420 |

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A material composition comprising:

aluminum (Al) in an amount of approximately 15 to 20% by weight (wt %);

molybdenum trioxide ($MoO_3$) present in an amount of approximately 32 to 41% by wt %;

potassium perchlorate ($KClO_4$) present in an amount of approximately 9 to 10% by wt %; and a binder.

2. The material composition of claim 1, wherein the binder comprises silicone.

3. The material composition of claim 2, further comprising a solvent.

4. The material composition of claim 3, wherein the solvent comprises xylene.

5. The material composition of claim 4, wherein silicone is present in an amount of approximately 25 to 28 wt %, and xylene is present in an amount of approximately 9 to 10 wt %.

6. The material composition of claim 4, wherein aluminum is present in amount of approximately 15.2 wt %, $KClO_4$ is present in an amount of approximately 9.3 wt %, $MoO_3$ is present in amount of approximately 40.6 wt %, silicone is present in amount of approximately 25.6 wt %, and xylene is present in amount of approximately 9.3 wt %.

7. The material composition of claim 6, wherein silicone is present in amount of approximately 25.6 wt % and xylene is present in amount of approximately 9.3 wt %.

8. The material composition of claim 4, wherein aluminum is present in amount of approximately 19.4 wt %, $KClO_4$ is present in an amount of approximately 10 wt %, and $MoO_3$ is present in an amount of approximately 32.6 wt %.

9. The material composition of claim 2, wherein the Al and the MoO3 are present in powder form.

10. The material composition of claim 9, wherein the Al powder exhibits an average size of approximately 0.08 microns.

11. The material composition of claim 10, wherein the MoO3 powder exhibits an average size of approximately 14.0 microns.

12. The material composition of claim 1, further comprising a solvent, wherein the composition contains approximately 55% solids concentration by volume.

13. The material composition of claim 8, wherein silicon is present in an amount of approximately 28 wt % and xylene is present in amount of approximately 10 wt %.

* * * * *